US006815626B1

(12) United States Patent
Hsu

(10) Patent No.: US 6,815,626 B1
(45) Date of Patent: Nov. 9, 2004

(54) OVERLOAD BREAKER

(76) Inventor: Yin Hsun Hsu, Hsmei 11-6, Damei Tsuen, Tston Hsiang, Yunlin Hsien (TW), 647

( * ) Notice: Subject to any disclaimer, the term of this patent is extended or adjusted under 35 U.S.C. 154(b) by 0 days.

(21) Appl. No.: 10/854,091

(22) Filed: May 25, 2004

(51) Int. Cl.[7] ..... H01H 23/04
(52) U.S. Cl. ..... 200/315; 200/339; 200/553
(58) Field of Search ..... 200/61.08, 553–563, 200/302.3, 303, 308, 310, 313–317, 339

(56) References Cited

U.S. PATENT DOCUMENTS 4,101,749 A * 7/1978 Josemans et al. ..... 200/317
4,115,673 A * 9/1978 Smith ..... 200/315
4,393,289 A 7/1983 Grenier ..... 200/147 R
5,660,270 A * 8/1997 Martin et al. ..... 200/315
6,013,885 A * 1/2000 Kowalczyk ..... 200/315
6,462,292 B1 * 10/2002 Wang ..... 200/315
6,590,175 B1 * 7/2003 Lam ..... 200/315
6,621,025 B2 * 9/2003 Yei et al. ..... 200/315

* cited by examiner

*Primary Examiner*—Ramon M. Barrera
(74) *Attorney, Agent, or Firm*—Charles E. Baxley

(57) ABSTRACT

An overload breaker includes a receptacle having three slots to receive three prongs, and a housing extended from the receptacle and having a space formed by a partition. An intermediate prong has a contact, and a conductor blade includes one end secured to one side prong and the other end for contacting with the contact of the intermediate prong. A neon lamp and a resistor are coupled between the intermediate and the other side prongs, and a switch button is pivotally attached to the housing and pivotally coupled to the other end of the conductor blade with a lever, to control the conductor blade to engage with or to be disengaged from the contact of the intermediate prong.

10 Claims, 4 Drawing Sheets

OVERLOAD BREAKER

BACKGROUND OF THE INVENTION

1. Field of the Invention

The present invention relates to an overload breaker, and more particularly to an overload breaker having an improved configuration for allowing the overload breaker to be easily manufactured and assembled.

2. Description of the Prior Art

Various kinds of typical overload breakers have been developed and provided for coupling to electric wires or cables, electric facilities, or the like, particularly for coupling in front of electric facilities, to prevent overload electric power source from supplying to the electric facilities, and thus to prevent the electric facilities from being damaged by the overload electric power energy.

For example, U.S. Pat. No. 4,393,289 to Grenier discloses one of the typical overload circuit breakers, and comprises a number of parts or elements received in a receptacle, and a number of spring members disposed in the receptacle, and engaged with the parts or elements, for biasing the parts or elements. In addition, a magnetic actuation device includes a magnetic actuation coil disposed in the receptacle.

However, it will be difficult to assemble the parts or elements and the spring members and the magnetic actuation coil of the magnetic actuation device within the tiny receptacle. Furthermore, the magnetic actuation device is expensive and may greatly increase the manufacture cost of the overload breakers.

The present invention has arisen to mitigate and/or obviate the afore-described disadvantages of the conventional overload breakers.

SUMMARY OF THE INVENTION

The primary objective of the present invention is to provide an overload breaker including an improved configuration for allowing the overload breaker to be easily manufactured and assembled.

In accordance with one aspect of the invention, there is provided an overload breaker comprising a receptacle including a chamber formed therein, and including three slots formed in bottom and communicating with the chamber thereof, the receptacle including a housing provided on top thereof and having a space formed therein and defined by a partition which is located between the housing and the receptacle, a first and a second and a third prongs engaged in the slots of the receptacle respectively, the second prong including a contact provided thereon, a conductor blade including a first end secured to the third prong, and a second end for selectively contacting with the contact of the second prong, and including an intermediate portion located between the first and the second ends thereof, a neon lamp received in the space of the housing, and including a first terminal extended through the partition and coupled to the second prong, and including a second terminal extended through the partition and coupled to the first prong, a resistor coupled to the second terminal of the neon lamp, a switch button pivotally attached to the housing with at least one pivot axle, and including a first end and a second end, and a lever including a first end pivotally coupled to the first end of the switch button, and including a second end having an actuator provided thereon, to engage with the second end of the conductor blade, and to move the second end of the conductor blade relative to the second prong, and to selectively engage and disengage the second end of the conductor blade from the contact of the second prong. The second end of the conductor blade is engageable with the contact of the second prong when the first end of the switch button and the lever are moved toward the second prong, and is movable away from the contact of the second prong when the second end of the switch button is moved toward the second prong, to move the lever away from the second prong.

The housing includes a groove formed therein and defined by at least one projection, to receive the first terminal of the neon lamp. The housing includes a groove formed therein and defined by at least one jut, to receive the second terminal of the neon lamp. The housing includes a width smaller than that of the receptacle, to form a shoulder between the housing and the receptacle.

A positioning device may further be provided for positioning the intermediate portion of the conductor blade in the receptacle, and includes an extension extended from the partition, to engage with the intermediate portion of the conductor blade, and to position the intermediate portion of the conductor blade in the receptacle.

The positioning device includes a bar engaged in the receptacle, and having a protrusion extended from the bar, to engage with the intermediate portion of the conductor blade, and to position the intermediate portion of the conductor blade in the receptacle. The receptacle includes an inverted T-shaped channel formed therein, to receive and retain the bar therein.

The housing includes a stud extended into the space thereof from the partition, to engage with the neon lamp, and to retain the neon lamp in the housing. The housing includes a fin extended into the space thereof from the partition, to engage with the neon lamp, and to retain the neon lamp in the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
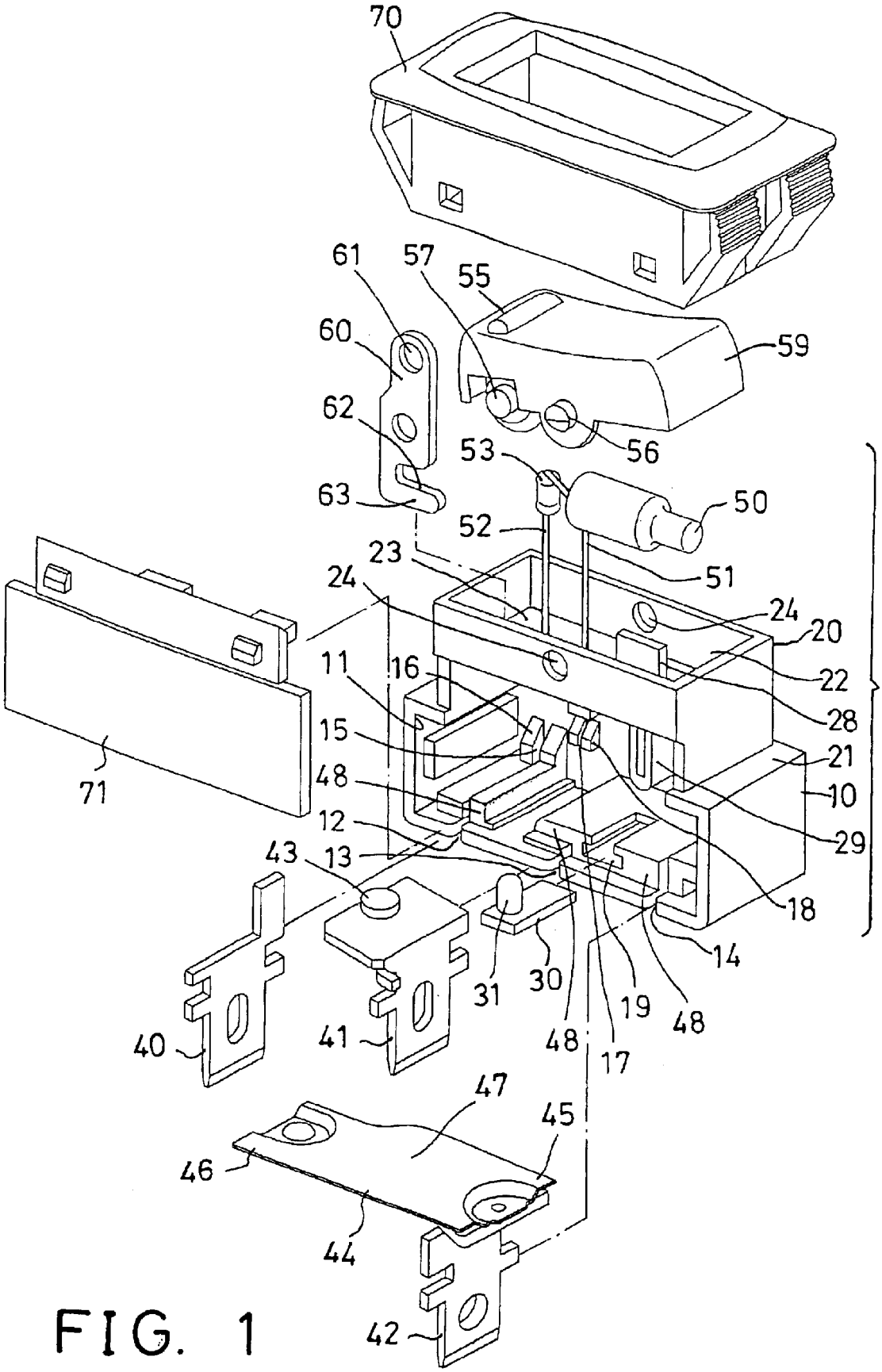
FIG. 1 is an exploded view of an overload breaker in accordance with the present invention.
Figure 2:
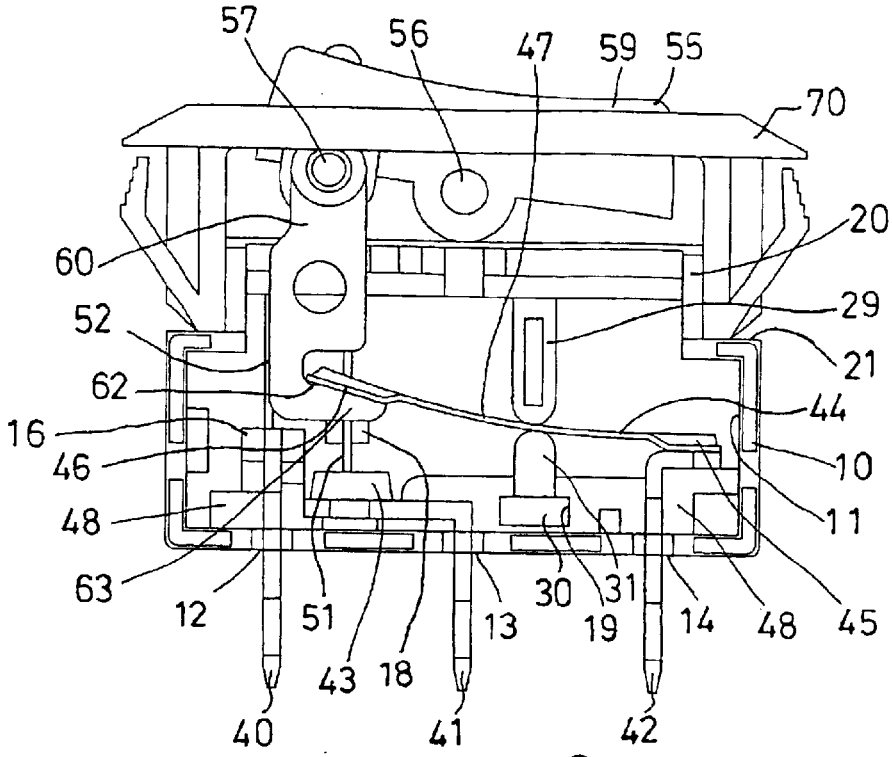
FIG. 2 is a front plan view of the overload breaker, in which a portion of the receptacle is removed or cut off to show an inner structure of the overload breaker.

Referring to the drawings, and initially to FIGS. 1 and 2, an overload breaker in accordance with the present invention comprises a receptacle 10 including a chamber 11 formed therein, and including three slots 12, 13, 14 formed in the bottom portion thereof and communicating with the chamber 11 thereof, to receive three prongs 40, 41, 42 respectively.

Figure 3:
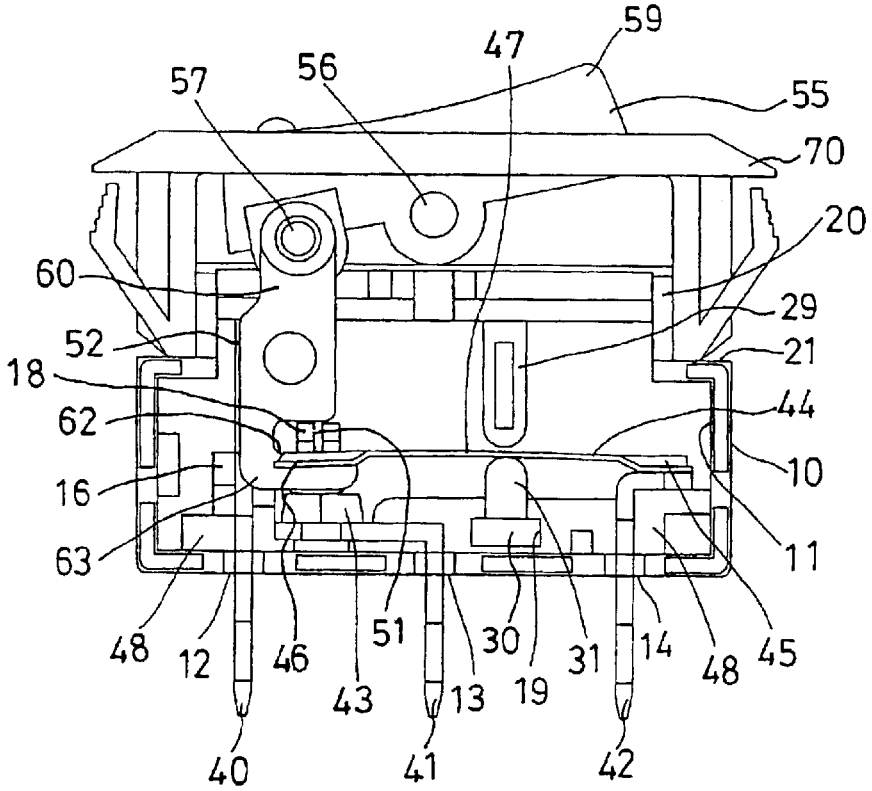
FIG. 3 is a front plan view similar to FIG. 2, illustrating the operation of the overload breaker.

One of the prongs 40–42, such as the intermediate prong 41 includes a contact 43 formed or provided thereon. A conductor blade 44 includes one end 45 secured to the other prong 42, and the other end 46 for selectively contacting or engaging with the contact 43 of the intermediate prong 41 (FIGS. 2–4), and includes an intermediate portion 47 formed or provided or located between the ends 45, 46 thereof. The prongs 40–42 may be retained or positioned within the receptacle 10 by a number of protuberances 48 (FIGS. 1–3).

Figure 6:
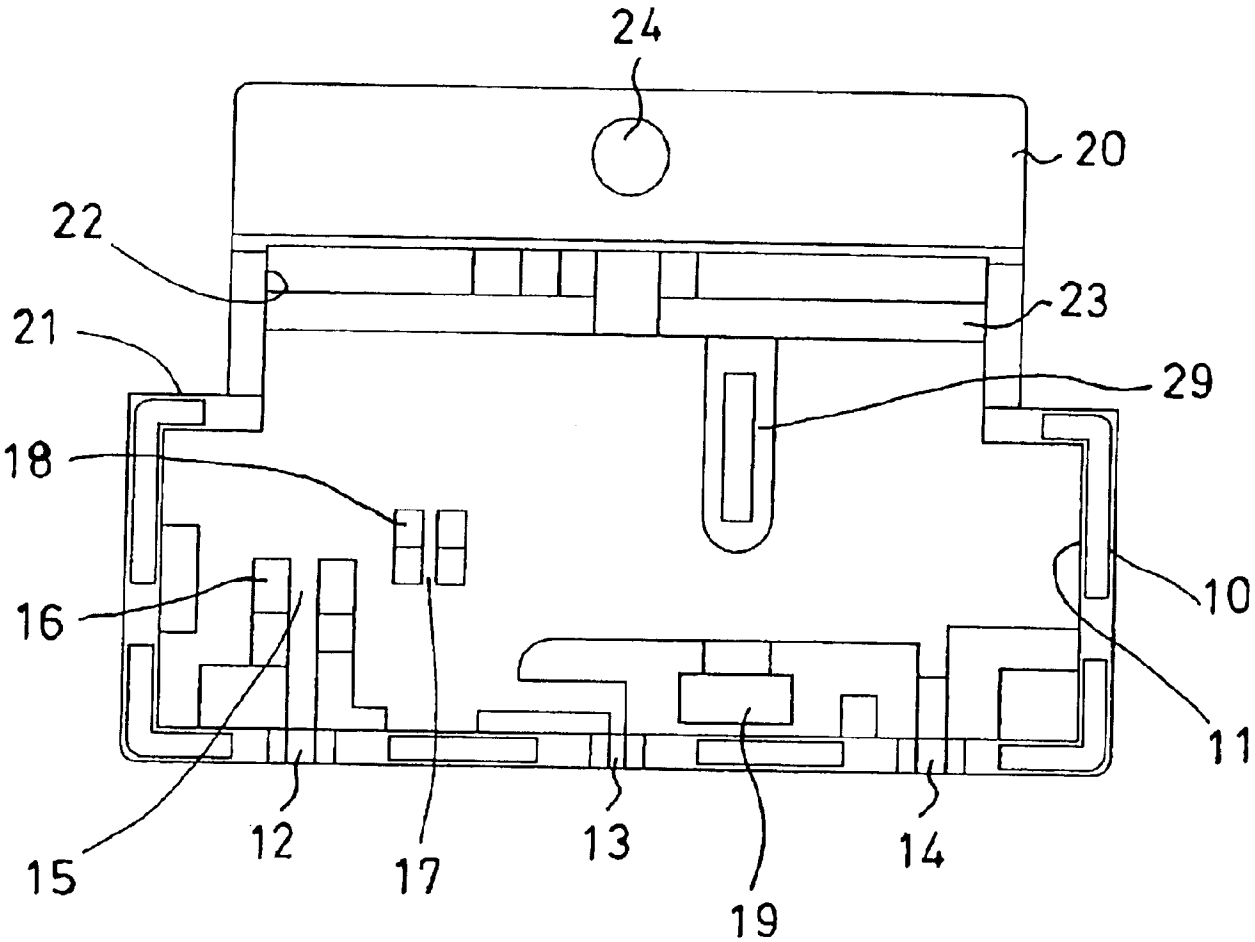
FIG. 6 is a front plan view of the receptacle of the overload breaker as shown in FIG. 5.

The receptacle 10 includes a groove 15 formed therein, and defined by one or more juts 16, and aligned with the slot 12 thereof (FIG. 6), and includes another groove 17 formed therein, and defined by one or more projections 18, and includes an inverted T-shaped channel 19 formed therein.

The receptacle 10 further includes a housing 20 formed or extended or provided on top thereof, and having a width or length smaller than that of the receptacle 10, to form one or more shoulders, or a peripheral shoulder 21 between the housing 20 and the receptacle 10.

Figure 5:
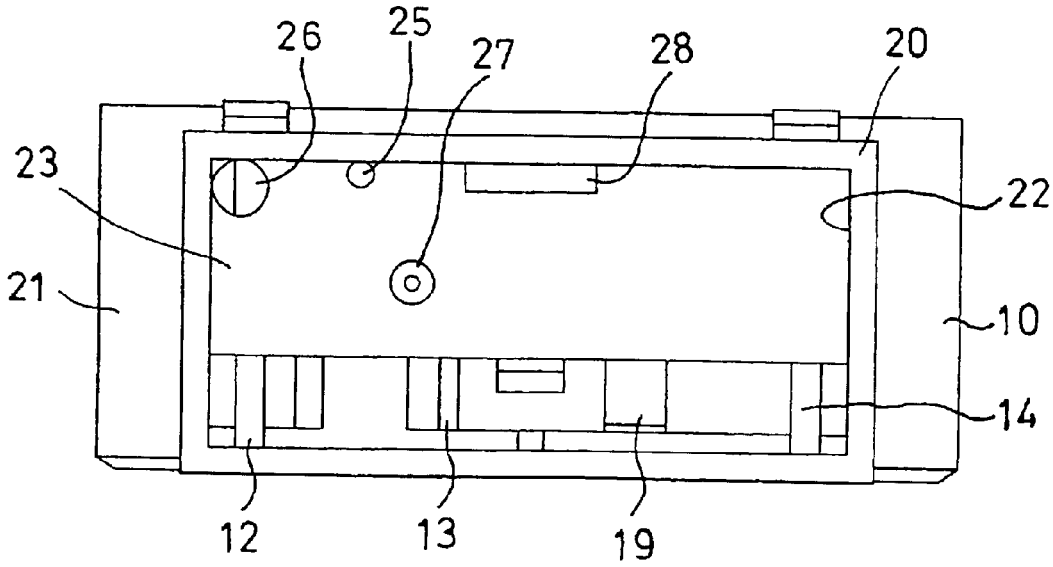
FIG. 5 is a top plan view illustrating a receptacle of the overload breaker.

The housing 20 includes a space 22 formed therein and defined by a partition 23 which is preferably located between the housing 20 and the receptacle 10, and includes one or more apertures 24 formed therein, and includes two orifices 25, 26 formed in the partition 23 (FIG. 5), and includes a stud 27 (FIG. 5) and a fin 28 (FIGS. 1, 5) extended into the space 22 of the housing 20 from the partition 23.

The housing 20 further includes an extension 29 extended downwardly from the partition 23 (FIGS. 2–4), to engage with the intermediate portion 47 of the conductor blade 44. A bar 30 is engaged and received in the channel 19 of the receptacle 10, and; includes a protrusion 31 extended therefrom, to engage with and: to position the intermediate portion 47 of the conductor blade 44, and to prevent the intermediate portion 47 of the conductor blade 44 from moving up and down relative to the receptacle 10.

A neon lamp 50 includes one prong or terminal 51 extended through one of the orifices 25 of the partition 23 of the housing 20, and engaged into and received in the groove 17 formed and defined between the projections 18, and secured or electrically coupled to the intermediate prong 41 with such as welding processes or the like.

The other prong or terminal 51 of the neon lamp 50 is extended through the other orifice 26 of the partition 23 of the housing 20, and engaged into and received in the other groove 15 formed and defined between the juts 16, and secured or electrically coupled to the prong 40 with such as welding processes or the like. A resistor 53 is attached or coupled to the other prong or terminal 51 of the neon lamp 50.

Accordingly, the resistor 53 and the neon lamp 50 may be electrically coupled between the prongs 40, 41 with the other prongs or terminals 51, 52 of the neon lamp 50. The conductor blade 44 may selectively contact or couple the prongs 41, 42 together. The neon lamp 50 may be positioned or retained or secured within the space 22 of the housing 20 with the stud 27 and/or the fin 28 of the housing 20.

A switch button 55 includes one or more axles 56 extended therefrom, and engaged into the apertures 24 of the housing 20, to pivotally or rotatably attach the switch button 55 to the housing 20, and to allow the switch button 55 to be rotated relative to the housing 20 with the pivot axles 56. The switch button 55 includes a pin 57 extended from one end thereof.

Figure 4:
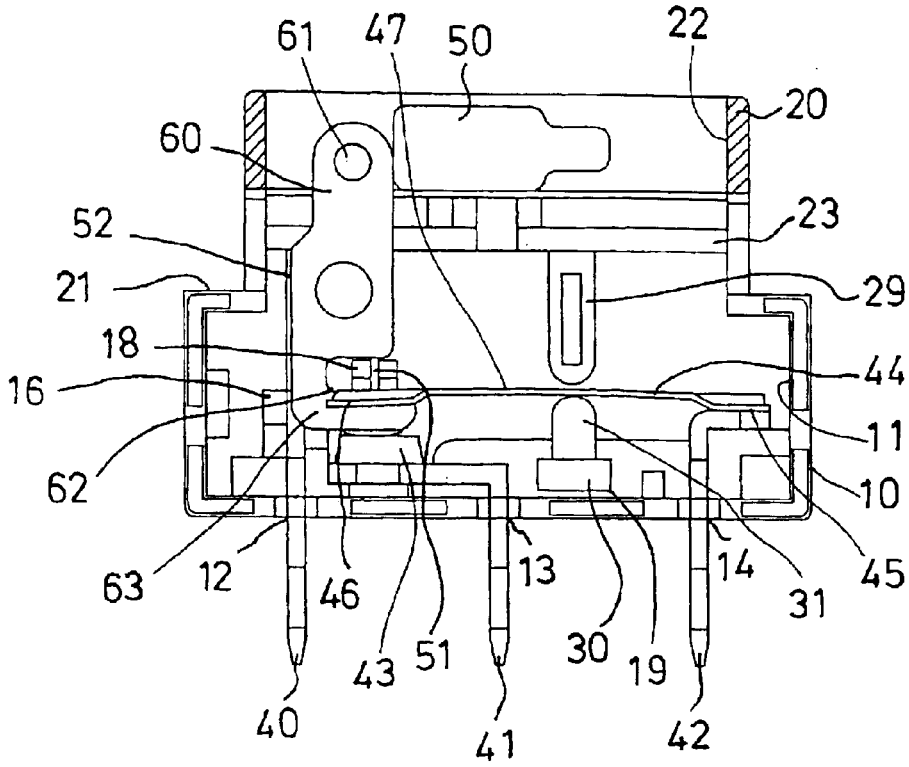
FIG. 4 is a front plan view similar to FIGS. 2 and 3, in which a switch button of the receptacle is removed or cut off to show an inner structure of the overload breaker.

A lever 60 includes a hole 61 formed in one end thereof to receive the pin 57, and to pivotally or rotatably attach or couple the lever 60 to the switch button 55. The lever 60 is slidably engaged through the partition 23 of the housing 20, and includes a cavity 62 formed in the other end thereof, and defined by a finger or an actuator 63, to receive and to engage with the other end 46 of the conductor blade 44, in order to move the other end 46 of the conductor blade 44 up and down relative to the prong 41, and to selectively engage and disengage the other end 46 of the conductor blade 44 from the contact 43 of the intermediate prong 41 (FIGS. 2–4).

A protective sleeve 70 may be attached or engaged onto the housing 20, and engaged with the peripheral shoulder 21 formed between the housing 20 and the receptacle 10, to shield the axles 56 of the switch button 55 and the apertures 24 of the housing 20. A cover 71 (FIG. 1) may be attached or secured to the receptacle 10, to retain the prongs 40–42 and/or the other parts or elements within the chamber 11 of the receptacle 10.

In operation, as shown in FIG. 2, when the other end 59 of the switch button 55 is depressed by the users or moved toward the receptacle 10 or the prong 41, the lever 60 may be elevated and moved away from the prong 41, to disengage the other end 46 of the conductor blade 44 from the contact 43 of the intermediate prong 41, and thus to switch off or cut off the electric coupling between the prongs 40, 42.

As shown in FIG. 3, when the other end 59 of the switch button 55 is released by the users, or when the one end of the switch button 55 is depressed by the users or moved toward the receptacle 10 or the prong 41, the lever 60 may be moved toward the prong 41, to allow the other end 46 of the conductor blade 44 to be engaged with the contact 43 of the intermediate prong 41, and thus to switch on or to actuate the electric coupling between the prongs 40, 42.

The resistor 53 and the neon lamp 50 are electrically coupled between the prongs 40, 41, and may be damaged automatically when an overload electric energy is supplied to the resistor 53 and the neon lamp 50, and thus to switch off or cut off the electric coupling between the prongs 40, 41 automatically when an overload electric energy is supplied to the overload breaker in accordance with the present invention.

It is to be noted that the prongs 40–42, and the conductor blade 44, and the bar 30 may be easily assembled into the chamber 11 of the receptacle 10, and the resistor 53 and the neon lamp 50 and the switch button 55 and the lever 60 may be easily assembled into the space 22 of the housing 20, such that the parts and the elements of the overload breaker may be easily assembled, and such that the overload breaker is good for mass production processes.

Accordingly, the overload breaker in accordance with the present invention includes an improved configuration for allowing the overload breaker to be easily manufactured and assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An overload breaker comprising:

a receptacle including a chamber formed therein, and including three slots formed in bottom and communicating with said chamber thereof, said receptacle including a housing provided on top thereof and having a space formed therein and defined by a partition which is located between said housing and said receptacle, a first and a second and a third prongs engaged in said slots of said receptacle respectively, said second prong including a contact provided thereon, a conductor blade including a first end secured to said third prong, and a second end for selectively contacting with said contact of said second prong, and including an intermediate portion located between said first and said second ends thereof, a neon lamp received in said space of said housing, and including a first terminal extended through said partition and coupled to said second prong, and including a second terminal extended through said partition and coupled to said first prong, a resistor coupled to said second terminal of said neon lamp, a switch button pivotally attached to said housing with at least one pivot axle, and including a first end and a second end, and a lever including a first end pivotally coupled to said first end of said switch button, and including a second end having an actuator provided thereon, to engage with said second end of said conductor blade, and to move said second end of said conductor blade relative to said second prong, and to selectively engage and disengage said second end of said conductor blade from said contact of said second prong, said second end of said conductor blade being engageable with said contact of said second prong when said first end of said switch button and said lever are moved toward said second prong, and being movable away from said contact of said second prong when said second end of said switch button is moved toward said second prong, to move said lever away from said second prong.

2. The overload breaker as claimed in claim 1, wherein said housing includes a groove formed therein and defined by at least one projection, to receive said first terminal of said neon lamp.

3. The overload breaker as claimed in claim 1, wherein said housing includes a groove formed therein and defined by at least one jut, to receive said second terminal of said neon lamp.

4. The overload breaker as claimed in claim 1, wherein said housing includes a width smaller than that of said receptacle, to form a shoulder between said housing and said receptacle.

5. The overload breaker as claimed in claim 1 further comprising means for positioning said intermediate portion of said conductor blade in said receptacle.

6. The overload breaker as claimed in claim 5, wherein said positioning means includes an extension extended from said partition, to engage with said intermediate portion of said conductor blade, and to position said intermediate portion of said conductor blade in said receptacle.

7. The overload breaker as claimed in claim 5, wherein said positioning means includes a bar engaged in said receptacle, and having a protrusion extended from said bar, to engage with said intermediate portion of said conductor blade, and to position said intermediate portion of said conductor blade in said receptacle.

8. The overload breaker as claimed in claim 7, wherein said receptacle includes an inverted T-shaped channel formed therein, to receive and retain said bar therein.

9. The overload breaker as claimed in claim 1, wherein said housing includes a stud extended into said space thereof from said partition, to engage with said neon lamp, and to retain said neon lamp in said housing.

10. The overload breaker as claimed in claim 1, wherein said housing includes a fin extended into said space thereof from said partition, to engage with said neon lamp, and to retain said neon lamp in said housing.

* * * * *